United States Patent [19]

Baughman

[11] Patent Number: 4,786,058

[45] Date of Patent: Nov. 22, 1988

[54] ELECTRIC TARGET AND DISPLAY

[76] Inventor: James S. Baughman, 1935 Dodge Rd., Deford, Mich. 48729

[21] Appl. No.: 64,662

[22] Filed: Jun. 22, 1987

[51] Int. Cl.[4] ..... F41J 5/00

[52] U.S. Cl. ..... 273/371; 273/373

[58] Field of Search ..... 273/348, 371, 373

[56] References Cited

U.S. PATENT DOCUMENTS

| | | | |
|---|---|---|---|
| 3,004,763 | 10/1961 | Knapp | 273/102.2 |
| 3,469,843 | 9/1969 | Hubbard | 273/102.2 |
| 3,529,828 | 9/1970 | Thalmann | 273/102.2 |
| 3,656,056 | 4/1972 | Dalzell, Jr. | 324/65 |
| 3,854,722 | 12/1974 | Öhlund et al. | 273/373 |
| 4,695,059 | 9/1987 | Yamashita et al. | 273/371 |

FOREIGN PATENT DOCUMENTS

| | | | |
|---|---|---|---|
| 3513783 | 10/1986 | Fed. Rep. of Germany | 273/371 |

*Primary Examiner*—Leo P. Picard
*Assistant Examiner*—Jessica J. Harrison
*Attorney, Agent, or Firm*—Krass & Young

[57] ABSTRACT

An electric indicating target for use in shooting practice which provides a user with a display indicating the zone of the target face that has been hit by a shot. The target includes a planar surface of electrical resistance elements formed on the target face and divided into a plurality of electrically insulated sectors. When the surface of a sector is penetrated by a relatively small projectile, the resistance of the sector increases by an amount indicative of a shot hitting the sector. The target further includes external circuits, each connected to a different sector of the target, that store the resistance of a sector and detect changes in this resistance indicative of a projectile hitting the sector. After a sector is hit, the associated circuit first signals so, and then stores the new resistance of the sector. A display device is connected to the external circuitry in order to provide a user with messages indicating which sector has been hit.

16 Claims, 4 Drawing Sheets

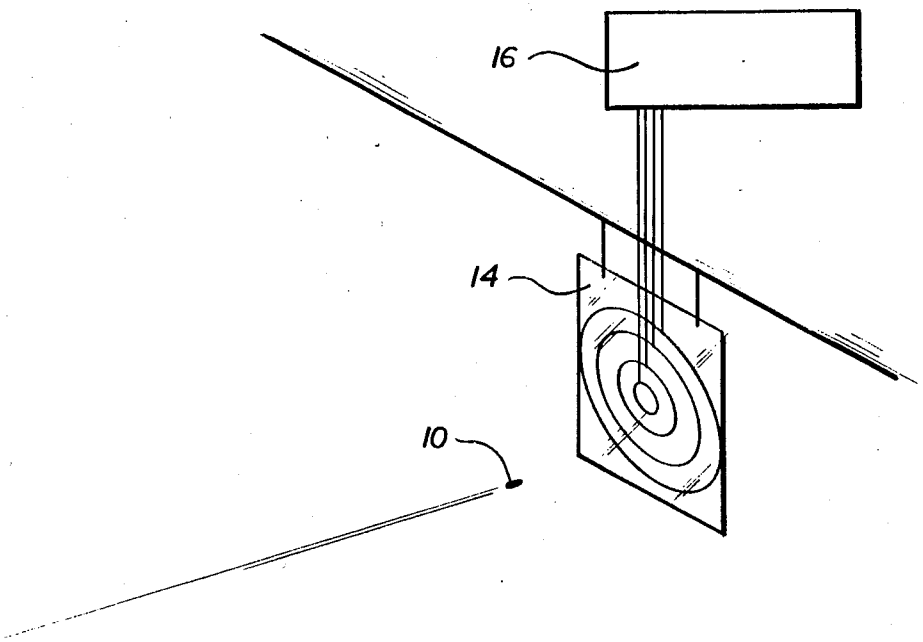
FIG. 1
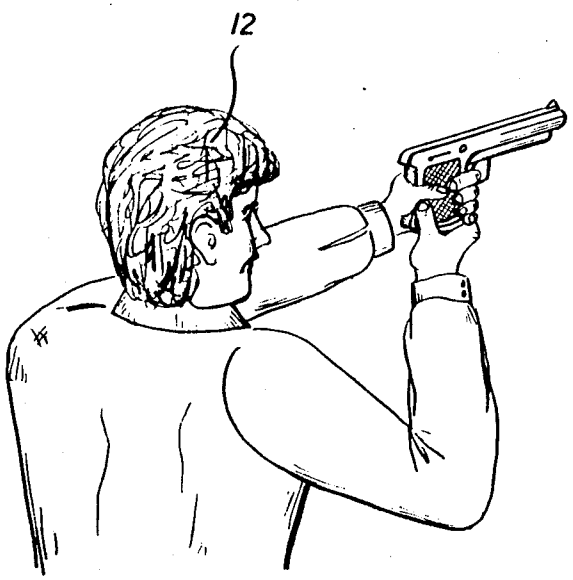

ELECTRIC TARGET AND DISPLAY

BACKGROUND OF THE INVENTION

1. Field of the Invention

This invention relates to targets for use in shooting practice and related electrical circuitry operative to provide a user with a display indicating the nature of a hit.

2. Description of the Related Art

Shooting targets are commonly used for recreational purposes and in the training of police officers and marksmen. Considerable effort has been put forth to create an electronic device which provides immediate feedback to the user indicating the success of his shot. Such apparatus allows the trainee to make immediate corrective action, and thereby spend his time more productively. Furthermore, it allows recreational users to keep track of their "score".

Previous U.S. Pats. employing an electrical self-indicating target include U.S. Pat. Nos. 3,004,763; 3,469,843; 3,529,828; and 3,656,056. Most of the prior art devices utilize separated electrodes formed on the target which are momentarily contacted by an electrically conductive bullet or other projectile to establish a short circuit therebetween. This short circuit is used to indicate that a projectile has hit the target. U.S. Pat. No. 3,529,828 discloses one such shorting type target divided into a plurality of zones with circuitry adapted to indicate which zone of the target is hit.

U.S. Pat. No. 3,569,843 discloses a target in which shorting occurs when a conductive layer of the target itself is forced into electrical contact with a backing layer of the target, eliminating the need for an electrically conductive projectile.

U.S. Pat. No. 3,004,763 discloses an indicating target which utilizes capacitance to indicate a hit. In that system the target is comprised of two electrically conductive plates separated by an insulator. Each plate has a capacitance with reference to the ground. When a projectile passes through one of the plates this capacitance is momentarily charged. A resistor network is utilized to measure this change.

U.S. Pat. No. 3,656,056 discloses a device which indicates the point a bullet or like projectile passes a line, or the direction from which it came. This device utilizes changes in electrical resistance. Penetration of the target decreases its resistivity by effectively shorting two conductive layers together.

Each of the above targets utilizes a system of indicating lights to display the results of a shot of the user.

These targets have a number of deficiencies. For example, in the conventional short circuit type detectors it has been found that high velocity projectiles may actually pass through the target without being detected. In addition, concentration of hits in small areas may cause the target to become unoperational. These targets are not easily replaced due to their high cost.

SUMMARY OF THE INVENTION

The present invention is directed towards solving these problems by providing an improved self-indicating target.

The present invention provides a target for use in shooting practice including a substantially planar target face supporting a surface with a given electrical resistance. When the surface is penetrated by a relatively small projectile, its resistance increases by at least a certain minimum amount greater than the normal amount of fluctuation in resistance, due to such factors as noise, characteristic of the resistive surface. The surface is connected to a sensing circuit operative to record the resistance and detect increases in this resistance indicative of a penetration by a relatively small projectile. The sensing circuit is designed to ignore the normal fluctuations in resistance, caused by such factors as noise, characteristic of the surface being used. The relatively small projectile may be a common sized bullet, a pellet, an arrow tip, or other such projectile. The projectile is not required to be electrically conductive.

After detecting an increase in resistance, the sensing circuit momentarily indicates, via an output line, the surface has been hit and then records the new resistance. A display device is connected to receive the output signal and indicates that the surface has been hit to the user.

In the preferred embodiment of the present invention, the target surface described above is divided into a plurality of resistive sectors electrically insulated from one another. Each sector is connected to a different sensing circuit of the type described previously. The borders of each sector are connected to the sensing circuits by conducting signal lines. In this embodiment, the display device indicates which sector has been hit to the user. Additional circuitry is provided to detect whether a signal line has been rendered unoperational due to a projectile hit.

The sectors may be arranged in concentric rings. This allows the display circuitry to indicate the distance from the center at which a projectile has hit the target. The sectors may alternatively be defined by radial lines, thereby allowing the display circuitry to indicate the location at which a projectile has hit. As yet another alternative, the radial line and concentric ring targets may be superimposed on one another to form a target face which allows the display circuitry to indicate both the distance from the center and the radial location of a hit.

In the preferred embodiment of the present invention, the target face consists of a sheet of paper with a graphite collodial suspension coating forming the previously described sectors. This embodiment allows for a very low cost target face, thereby allowing the target face to be a throw-away item that can be replaced when it becomes unoperational. Alternative embodiments may utilize other low cost methods such as thin film circuitry with the required electrical properties.

In the preferred embodiment of the invention the target face hangs from an overhead trolley. This embodiment is only useful when the shooting apparatus is a gun. An alternative embodiment provides a target face supported on a rigid backing of a common standing target. This embodiment allows for the use of other projectiles such as arrows.

The display device of the preferred embodiment consists of an audio annunciator using an electronic voice synthesizer with different messages for each sector. Alternative embodiments may utilize a CRT screen, lights, or any other suitable display device.

BRIEF DESCRIPTION OF THE DRAWINGS

The objectives, advantages and applications of the present invention will be made apparent by the following detailed description of the preferred embodiment and alternative embodiment of the invention. The description makes reference to the accompanying drawings in which:

FIG. 1 is a perspective view of a shooting target with a display to indicate the success of a shot, forming the preferred embodiment of the present invention.

DESCRIPTION OF THE PREFERRED EMBODIMENTS

FIG. 1 depicts a preferred embodiment of the present invention in use. When a projectile 10 shot by a user 12 hits a target 14, circuitry associated with the target signals a display device 16 which provides the user with information regarding the nature of the hit. The operation and construction of the present invention are hereinafter described in detail.

Figure 2:
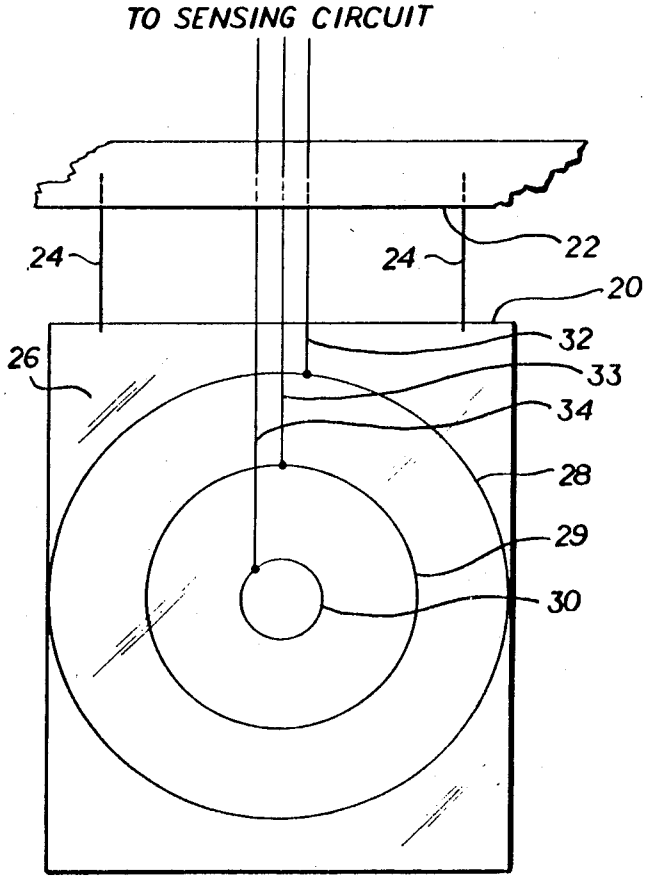
FIG. 2 is a front view of a target forming the preferred embodiment of the invention.

FIG. 2 depicts a preferred embodiment of the present invention in which a planar target surface 20 that is rectangular in shape and formed of paper is located on an overhead trolley 22. The target hangs from the trolley by means of supports, indicated at 24.

The principles of the present invention can be best illustrated by reference to an embodiment in which a planar circular target face, generally indicated at 26, consists of a surface formed of electrical resistor elements which are organized radially and are connected in parallel. These resistors are divided into sectors that are electrically insulated from one another. The target diagram drawn onto the target face corresponds with the pattern of the sectors.

Figure 3:
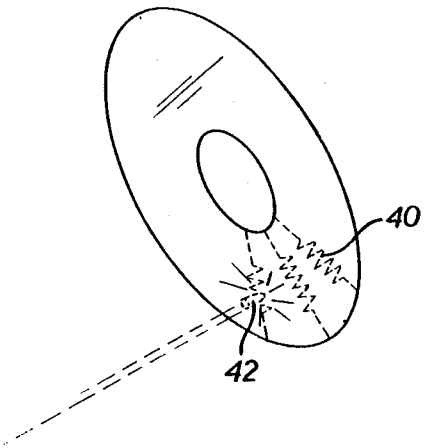
FIG. 3 is a cross-sectional view of one sector of the target of FIG. 1.

FIG. 3 depicts an example sector. For purposes of illustration each sector is defined to be composed of 288 one megohm resistors, of the type indicated at 40, connected in parallel. These resistors are represented at 48 in the sensing circuit depicted in FIG. 4. A different sensing circuit is connected to each sector on the target face. When a projectile 42 hits the target face, at least one resistor 40 is broken in the sector in which the projectile has hit. This breakage causes the resistance of the sector to increase. When only one resistor is broken, the sector's resistance increases by the minimum amount which can be caused by a penetrating projectile. In this case, the minimum amount is a change of approximately 0.35% This minimum amount is greater than the normal amount of fluctuation in resistance, due to factors such as noise, that is characteristic of the sector's surface. The sensing circuit, subsequently described in detail, detects increases in resistance which are greater than or equal to this minimum amount.

Although this embodiment utilizes actual electrical resistors in the target face, surfaces composed of materials which display the necessary electrical properties can be used. In the preferred embodiment, the surface of the sectors consists of a coating of graphite collodial suspension. This has been found to have the required electrical properties. Alternative embodiments may include a target face consisting of a thin film displaying the required electrical properties.

The borders of each sector are connected to signal lines consisting of conductors, preferably silver/copper suspension. Examples of such signal lines are indicated at 28–30 in FIG. 2. The signal lines are electrically connected to output lines which carry the signals from the resistive sectors to the external sensing circuits. Examples of such output lines are indicated at 32–34 in FIG. 2. The preferred embodiment includes additional external circuitry operative to monitor whether all output and signal lines are intact and signal the user, via a display device subsequently described, when one is rendered unoperational due to a projectile hit.

Figure 4:
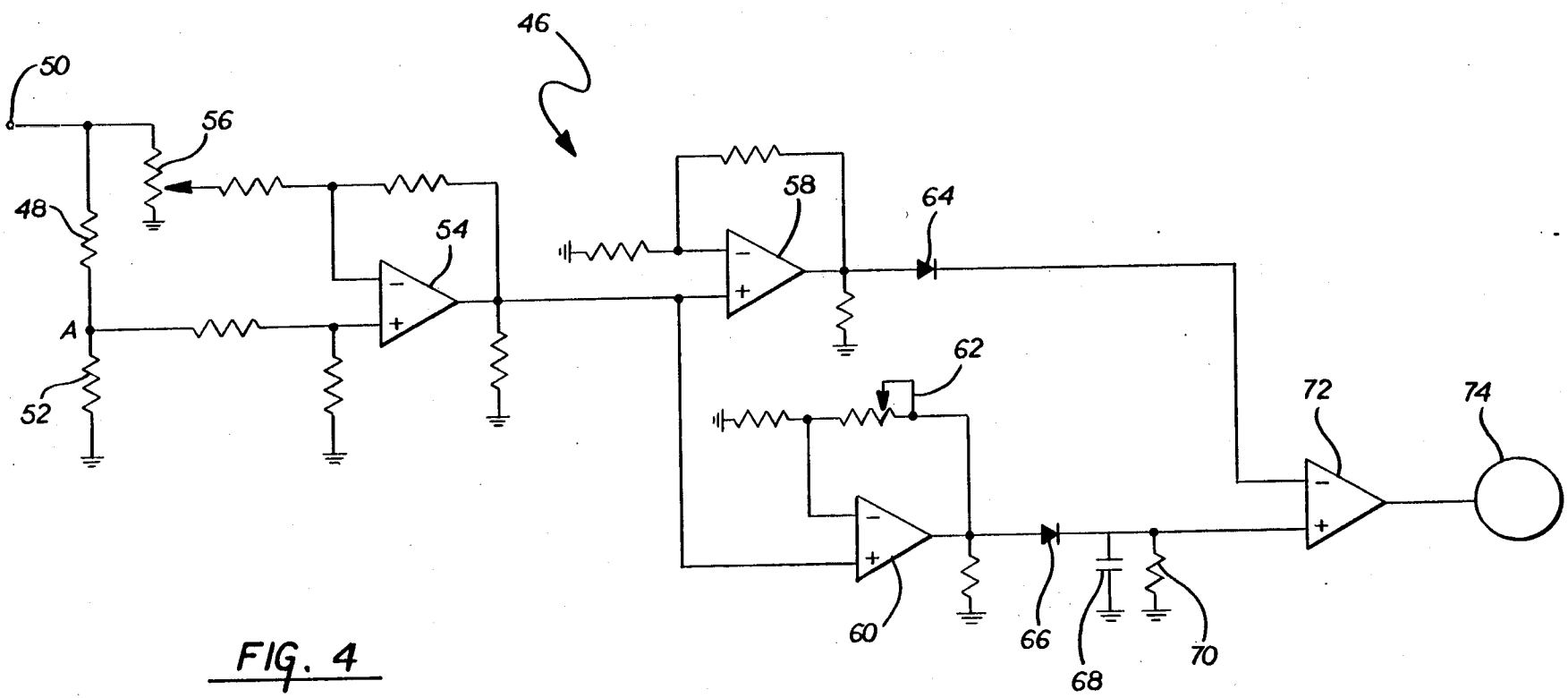
FIG. 4 illustrates a sensing circuit for the sectors of a target.

FIG. 4 depicts a sensing circuit, generally indicated at 46, which detects whether the sector to which it is connected has been hit by a projectile. A different circuit 46 is connected with each sector of the target. The resistor at 48 represents the resistance of the sector connected to circuit 46.

The circuit 46 operates in the following manner. A power supply voltage 50 is applied to one side of the the resistor 48. The resistors at 52 and 48 form a voltage divider. An increase in the resistance at 48 corresponds to an increase in the voltage at point A. A subtractor 54 strips the voltage at point A so that the remaining signal consists of the fractional part of the voltage value. This is the portion of the voltage which changes. The subtracted voltage is derived from the power supply 50 through a potentiometer 56. This serves to null out power supply variations.

The output of 54 is supplied simultaneously to two different voltage gain amplifiers 58 and 60. 60 is a variable gain operational amplifier. A potentiometer 62 is set such that 60 has an output slightly higher than the output of 58. The potentiometer 62 is used to adjust sensitivity in order that the circuit only detects increases in resistance caused by a penetrating projectile and ignores small changes caused by noise and other factors.

The outputs of 58 and 60 are fed through isolation diodes 64 and 66. The diode 66 prevents a charge on the capacitor 68 from causing feedback into the variable op amp 60.

The output 58 is connected, through the diode at 64, to the inverting input of a comparator 72. The output of 60 charges the capacitor 68 through the isolation diode 66. A shunting resistor 70, is connected to the capacitor 68 and provides a time constant. This RC combination stores a voltage indicative of the value of the voltage at point A before a penetrating projectile causes the resistance at 46 to increase. This voltage is applied to the non-inverting input of the comparator 72. The comparator compares the voltage from the capacitor to the instantaneous voltage at the inverting input. The rate of change necessary to turn on the comparator is determined by the time constant of the RC combination of 68 and 70. The time constant is set so that slow changes are ignored. When the comparator does detect an increase in the voltage at A, its output signals high momentarily and then the new voltage is stored in the RC combination and the output goes low.

The output of the comparator is connected to additional circuitry 74 which controls a display device. The preferred embodiment includes an audio annunciator which is driven by the different output lines and provides a different audio message for each sector of the target face. Alternative embodiments include display devices such as CRTs and lights. The connection of such display devices constitutes common knowledge to those skilled in the art.

Figure 5:
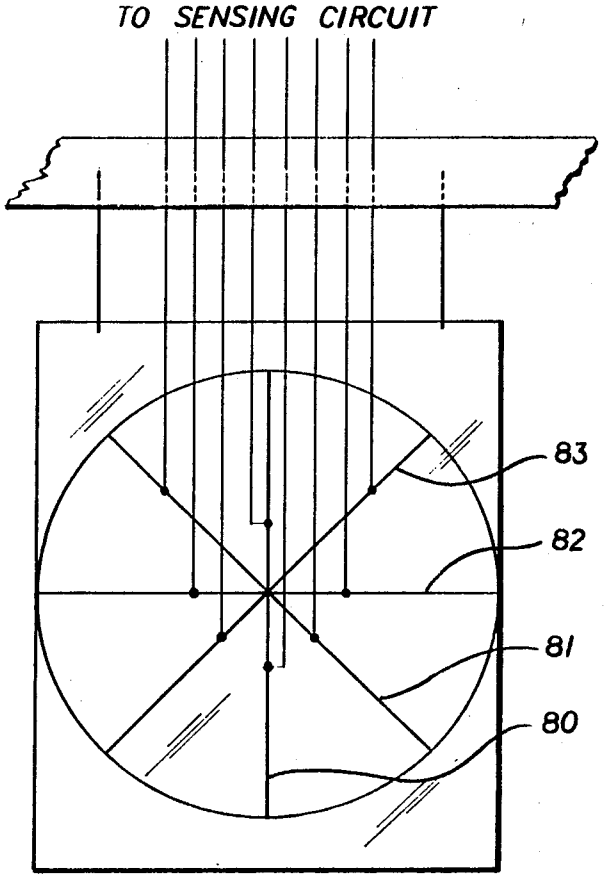
FIG. 5 illustrates a target face on a target forming the preferred embodiment of the invention.

FIG. 5 depicts a representative sectoring of the target face in the preferred embodiment. In this case, the target face is divided into sectors by radial signal lines 80–83. This method of sectoring allows the display device to indicate the location at which a projectile has hit the target surface.

Figure 6:
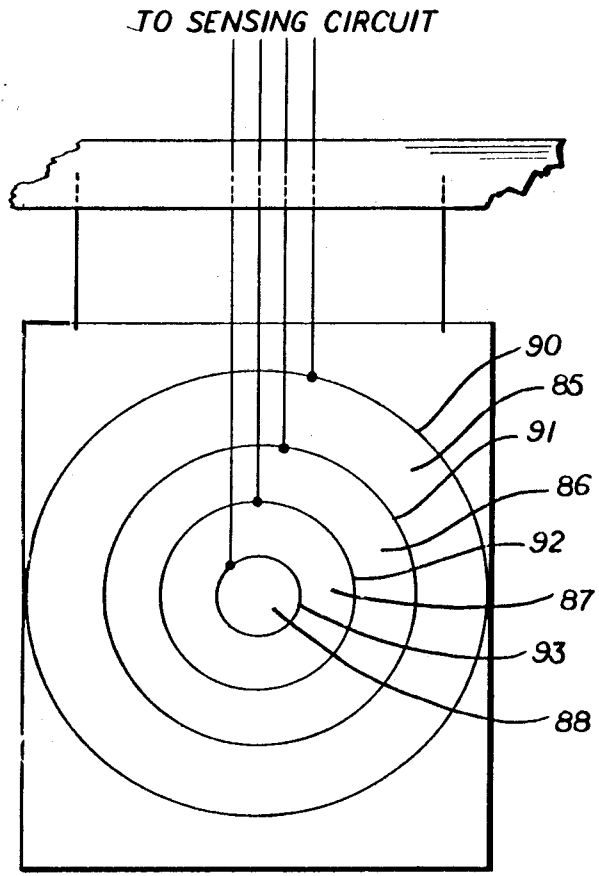
FIG. 6 illustrates an alternative form of target face on a target forming the preferred embodiment of the invention.

FIG. 6 depicts another example sectoring of the target face in the preferred embodiment. In this case, the sectors are concentric rings 85–88 defined by concentric signal lines 90–93. This method of sectoring allows the display device to indicate the distance from the center at which a projectile has hit the target face.

Figure 7:
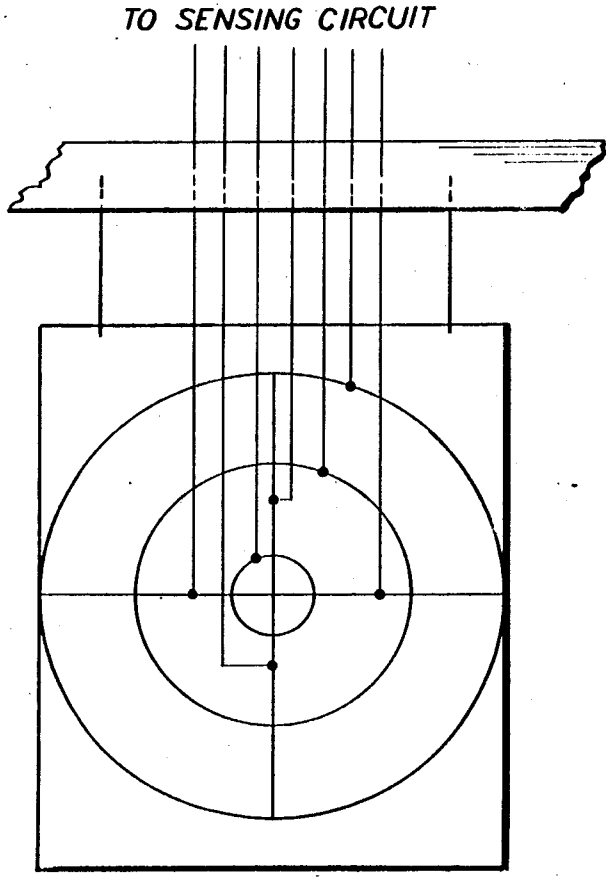
FIG. 7 illustrates yet another form of target face on a target forming the preferred embodiment of the invention.

FIG. 7 indicates yet another example sectoring of the target face of the preferred embodiment. This case illustrates the superimposing of the target faces of FIGS. 5 and 6. An appropriate "matrixing" circuitry logic allows the display device to indicate both the radial location and the distance from the center at which a projectile has hit the target. This "matrixing" logic is well known to those skilled in the art.

Methods of insulating the sectors in the above three examples are known to those skilled in the art. The resolution, meaning the number of sectors, in any of the above examples can be increased or decreased as needed. For example, if an indicating target operative to indicate only whether a projectile has hit it is needed, the target face requires only one sector which covers the entire target face.

Figure 8:
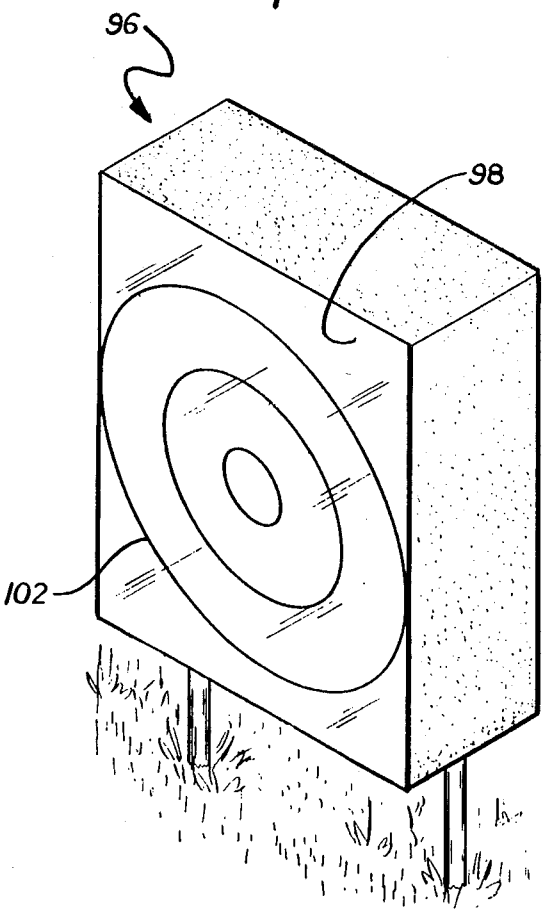
FIG. 8 is a front view of a target forming an alternative embodiment of the invention.

FIG. 8 illustrates an alternative embodiment of the present invention which allows the use of projectiles other than guns, such as arrows. The target, generally indicated at 96, of FIG. 8 is a common standing target which is comprised of a frame 98 supported by a foot 100 which is supported by the ground. The target face 102 meets the same requirements as described previously. However, 102 is supported on the rigid planar surface of the target frame 98.

Having thus described my invention, I claim:

1. A target for use in shooting practice including:

a substantially planar member having electrical resistance means supported on one face thereof, said resistance means including a plurality of sectors electrically insulated from one another, each sector having the property of its resistance increasing when a portion thereof is penetrated by a projectile, whereby an increase in resistance of a sector is indicative of a shot hitting said sector.

2. The device of claim 1 wherein said plurality of sectors are arranged in concentric rings.

3. The device of claim 1 wherein said plurality of sectors are defined by radial lines dividing said electrical resistance means into separate regions.

4. The device of claim 1 wherein said plurality of sectors are formed by superimposing a target face wherein said said plurality of sectors are arranged in concentric rings with a target face wherein said plurality of sectors are defined by radial lines.

5. The device of claim 1 further including a plurality of sensing circuits each connected to a different sector and operative to record the resistance thereof and detect an increase in said resistance indicative of a shot hitting said sector.

6. The device of claim 5 wherein the outputs of said sensing circuits have two states, a stable state where no increase in the resistance of said sector has been detected, and a momentary state where said circuit is in the process of recording a new resistance value, upon the completion of which the output returns to said stable state.

7. The device of claim 5 including further circuitry connecting said sensing circuits to a display device operative to indicate which sector has been hit by a shot.

8. The device of claim 7 wherein said display device includes an audio annunciator operative to provide a different audio messge for each of said sectors.

9. The device of claim 1 wherein said planar member is formed of paper and said electrical resistance means comprises a coating of graphite collodial suspension formed on said planar member.

10. A target for use in shooting practice including:

a substantially planar member having electrical resistance means supported on one face thereof, said resistance means including at least one sector which undergoes an increase in resistance by an amount greater than the common amount of fluctuation in resistance characteristics of said resistance means when penetrated by a projectile;

a sensing circuit connected to said sector operative to store a voltage value indicative of the resistance thereof in a resistor-capacitor network, and to detect an increase in said voltage indicative of a projectile hitting said sector, said circuit including a comparator connected to receive as one input a voltage indicative of the instantaneous resistance of said sector, and as a second input the voltage stored in said resistor-capacitor network, the output thereof comprising the output of said sensing circuit.

11. The device of claim 10 wherein the output of said sensing circuit has two states, a stable state in which said instantaneous voltage and the voltage stored in said resistor-capacitor network are approximately equal, and a momentary state in which said instantaneous voltage is greater than said voltage stored in the resistor-capacitor network by an amount indicative of a shot hitting said sector wherein said resistor-capacitor network is in the process of charging up to a new voltage level indicative of the new resistance of the penetrated sector, upon the completion of which the output returns to said stable state.

12. The device of claim 10 wherein said electrical resistance means consists of a plurality of said sectors electrically insulated from one another.

13. The device of claim 12 further including a plurality of said sensing circuits each connected to a different sector.

14. The device of claim 10 including further circuitry connecting said sensing circuits to a display device operative to indicate which sector has been hit.

15. The device of claim 14 wherein said display device includes an audio annunciator operative to provide a different audio message for each of said sectors.

16. The device of claim 10 wherein said planar member is formed of paper and said electrical resistance means comprises a coating of graphite collodial suspension formed on said planar member.

* * * * *

UNITED STATES PATENT AND TRADEMARK OFFICE

CERTIFICATE OF CORRECTION

PATENT NO. : 4,786,058

DATED : November 22, 1988

INVENTOR(S) : Baughman

It is certified that error appears in the above-identified patent and that said Letters Patent is hereby corrected as shown below:

Column 1, line 31, "3,569,843" should be --3,469,843--.

Column 1, line 51, "of" (second occurrence) should be --to--.

Signed and Sealed this

Fourth Day of July, 1989

*Attest:*

*Attesting Officer*

DONALD J. QUIGG

*Commissioner of Patents and Trademarks*